US005829072A

United States Patent [19]

Hirsch et al.

[11] Patent Number: 5,829,072

[45] Date of Patent: Nov. 3, 1998

[54] AUTOMATIC SHOWER CONTROL

[75] Inventors: Heinz Hirsch, Soest; Heinz-Dieter Eichholz, Iserlohn; Hans-Jürgen Ludewig, Rintein; Günter Kolbert, Iserlohn, all of Germany

[73] Assignee: Friedrich Grohe AG, Hemer, Germany

[21] Appl. No.: 587,884

[22] Filed: Jan. 11, 1996

[30] Foreign Application Priority Data

Jan. 14, 1995 [DE] Germany ..... 195 01 014.0

[51] Int. Cl.[6] ..... E03C 1/05

[52] U.S. Cl. ..... 4/605; 604/623; 604/668

[58] Field of Search ..... 4/597, 605, 615, 4/623, 604, 675, 668, 546, 559; 239/70, 73, 99; 251/129.04; 137/624.11, 624.12, 624.2

[56] References Cited

U.S. PATENT DOCUMENTS

| | | | |
|---|---|---|---|
| 4,921,211 | 5/1990 | Novak et al. . | |
| 4,941,219 | 7/1990 | Van Marcke | 251/129.04 |
| 4,981,158 | 1/1991 | Brondolino et al. | 251/129.04 |
| 5,570,869 | 11/1996 | Diaz et al. | 4/623 |

FOREIGN PATENT DOCUMENTS

| | | | |
|---|---|---|---|
| 36 42 698 | 6/1988 | Germany . | |
| 41 06 539 | 9/1992 | Germany . | |
| 3235824 | 10/1991 | Japan | 4/623 |
| 4005345 | 1/1992 | Japan | 4/623 |
| 4083027 | 3/1992 | Japan | 4/623 |
| 5287785 | 11/1993 | Japan | 4/623 |
| 06327579 | 11/1994 | Japan | 4/605 |
| WO 89/09312 | 10/1989 | WIPO . | |

*Primary Examiner*—Robert M. Fetsuga
*Attorney, Agent, or Firm*—Herbert Dubno; Yuri Kateshov

[57] ABSTRACT

An automatic shower control for the flow to a shower head by a detection device and its control and evaluation circuitry which detects the presence of a user and includes switching device for activation and deactivation of the control. An intensity selective evaluation of the detector signal indicates whether the signal derives from an object in a close proximity range or a normal proximity range to the detector and the system is switched on by the presence of an object in the close proximity range. During operation in the normal proximity range, which can terminate when the user leaves this range, water shut off can also be effected by movement of an object into the close proximity range.

3 Claims, 2 Drawing Sheets

AUTOMATIC SHOWER CONTROL

FIELD OF THE INVENTION

The present invention relates to an automatic shower control and, more particularly, to a control system for regulating the water flow from a shower head.

BACKGROUND OF THE INVENTION

In German Patent Document DE 36 42 698 A1, an automatic flow control for a shower head is described in which the presence of a user is detected by a detector which controls a valve for effecting flow of water to the shower head. In practice, the presence of the user is detected by a proximity switch or a sensor and the latter through an appropriate circuit can turn on the shower. The device has a manually actuatable button which reliably starts the automatic shower control. The water flow terminates and the automatic shower control is deactivated when the user no longer is in the proximity of the sensor or detector. Contactless initiation of the control operation is not provided in this system.

German Patent Document DE 41 06 539 A1 describes a shower control which operates in a contactless manner in which both the turning on of the water flow and the turning off of the water flow can be effected with the aid of a second sensor device provided with a second operational range, the two shower control devices being connected together by a circuit. This doubling of the number of sensors over the first system described is, of course, relatively expensive.

OBJECTS OF THE INVENTION

It is the principal object of the present invention to provide an improved shower control which allows contactless turning on and turning off of the water flow to a shower head in a simple and economical manner.

Another object of this invention is to provide a shower control system which is of low installation cost but yet can reliably operate the shower without the need for mechanical actuation of the system.

SUMMARY OF THE INVENTION

These objects and others which will become apparent hereinafter are attained, in accordance with the invention in an automatic shower control which comprises a detector responsive to the presence of a user in an area in the path of water emerging from a shower head, a valve unit controlling flow through the shower head and a control and evaluation circuit which is connected between the detector and the valve and is responsive to the detection signal and especially an amplitude or intensity value thereof and at a predetermined intensity value of the detector output automatically activates the shower control circuit and deactivates the same.

According to the invention, the predetermined intensity value is reached upon movement of an object, e.g. a hand of the user, into a detection cone within a certain proximity range, for example, up to 100 mm from the detector (hereinafter referred to the close range). The detection cone is an imaginary cone within which the proximity detector is effective.

According to a feature of the invention, the circuitry is so arranged that after activation, the water flow is commenced for a predetermined time interval $T_N$, and presence of the user in the normal proximity range is detected during this time interval. If an object, say the user, is not detected during the time interval $T_N$ after a predetermined time $T_R$ at which the circuit is still in its normal range, the shower control automatically is deactivated (automatically reset) and the proximity detection is again returned to close range.

According to a feature of the invention, by the introduction of an object into the close range region during the normal range proximity detection, e.g. the hand of the user into the close range region of the detection cone, the control electronics blocks the water flow and thereafter the response mode is no longer normal proximity detection but is replaced by close range response. Should a person enter the normal proximity range, e.g. for cleaning of the shower, but does not enter the close range, water supply will remain cut off.

The control and evaluation electronics can be so provided that the close range proximity detection is up to 100 mm from the detector while the normal range is from 100 to 800 mm therefrom, preferably 600 to 800 mm from the detector.

With the invention, therefore, the automatic shower can be automatically turned on and off in a contactless manner and an additional on or off switch is not necessary.

Once the user has positioned himself or herself in the normal detection range of the sensor and in the path of the discharge from the shower head, the shower operation is commenced by moving one's hand into the close range region, i.e. proximal to the detector. This region should be preferably less than 100 mm away from the detector and does not require contact with the detector. The shower operation commences as a result of the detection of the high amplitude signal generated by the proximity sensor upon the movement of the object close to it. This high amplitude signal is a reliable signal for commencing the showering operation and to switch over the detector to its normal function, i.e. maintaining the water flow as long as the user is within the normal showering range, i.e. from 100 mm or more from the detector. The high amplitude signal thus commences the START function.

The activation of the shower also sets in operation a time interval $T_N$ during which shower operation continues unless flow is cut off by another high amplitude signal as will be described. During this interval the proximity sensor operates at normal range. The switchover to normal range allows the proximity sensor to operate in the manner described in the aforementioned patent documents so that showering continues in the usual manner. A movement of the hand of the user into the close proximity range generates another high amplitude signal which is recognized as a STOP function and turns off the water flow independent of the presence of an object in the normal range, thereby terminating as well the normal range operation of the proximity sensor. The latter is reset to respond to a close range object. A new start is then possible when the user moves close to the proximity sensor (START function).

After a certain time period $T_R$, following the period $T_N$ in which no object is detected in the normal range operating mode, the shower control is automatically cut off and the system is reset to respond to a close proximity activation. This function can be termed an AUTO RESET. During the period $T_R$ where no object is detected, there is no water flow. A commencement of water flow is however possible in any case by detection of an object in the normal range during this period. After the time period $T_R$ has expired the START function is enabled to permit start up of the system, i.e. by detection of an object in close range.

According to a feature of the invention, the circuit can set a maximum duration of showering. This maximum duration $T_{MAX}$ can be selected is dependent upon the location of the shower, to run from one to ten minutes, and preferably is about five minutes.

According to the invention, when an object is detected within the normal range and the shower has been turned on, a timer of the circuit setting the $T_{MAX}$ is actuated. Upon the expiration of $T_{MAX}$ the stop function is transmitted to the valve to cut off the flow.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
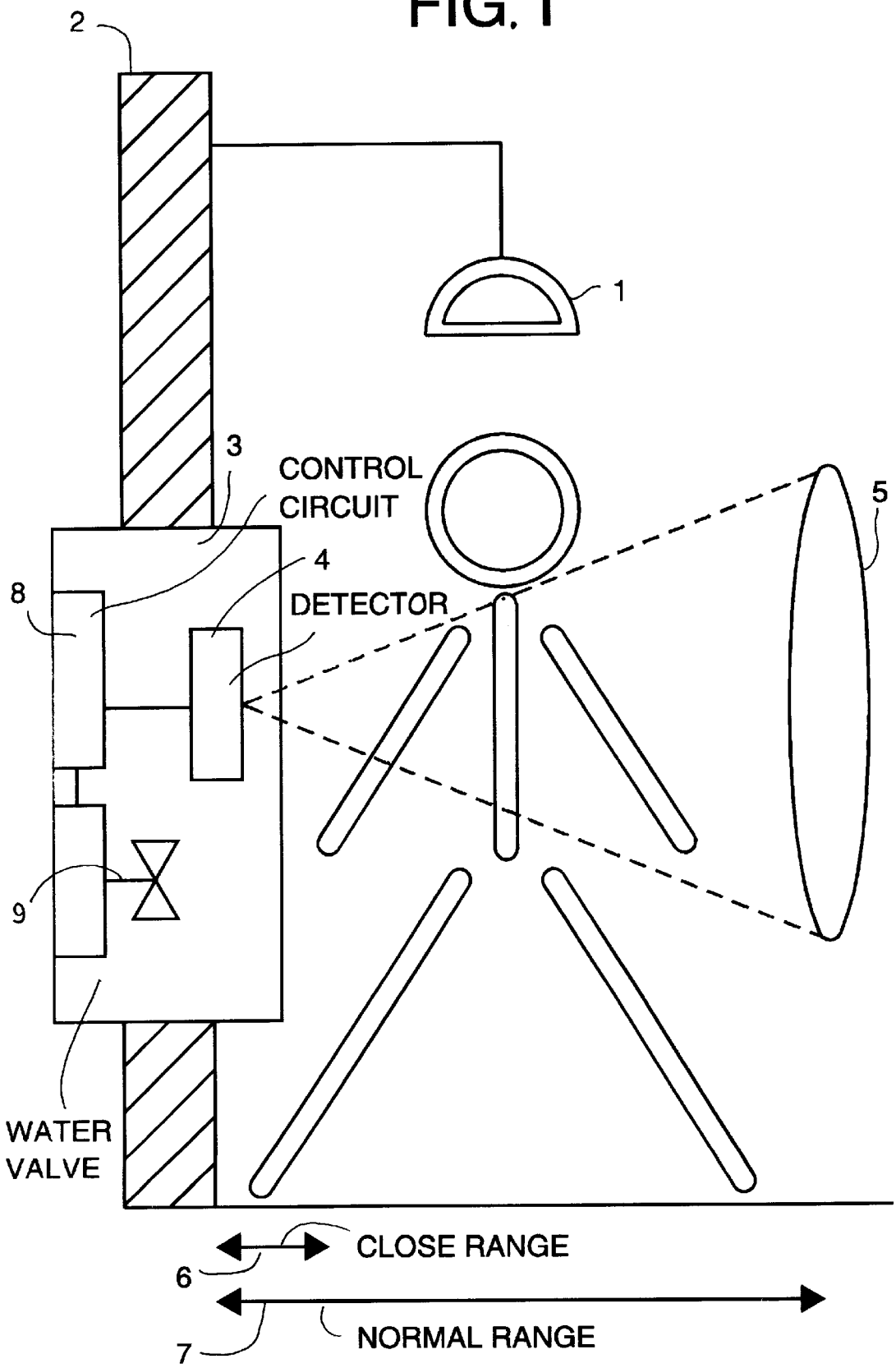
FIG. 1 is a diagram illustrating a shower system according to the invention.

The shower of the invention can comprise a shower installation 2 provided with a shower head 1 which can be any type of shower system including institutional showers having a row of shower heads laterally spaced apart without dividers between them or showers separated by dividers but with incomplete shower stalls.

In any case, for the or each shower head 1, recessed in the wall 2 is a housing which is provided with a proximity sensor 4 having a circuit 8 providing control and evaluation functions and generally including a programmed microprocessor. The latter is connected to a magnetic valve 9 which controls the water flow to the shower head 1. The valve 9 is connected by pipes (not visible in the drawing) on the one hand to the water mixing valve arrangement setting the temperatures and on the other hand with the shower head 1. The magnetic valve 9 is operated by the control circuit 8.

The detector 4 can be an active infrared light device which is responsive in a detection cone 5 represented diagrammatically and in which, when infrared light impinges on an object, for example an individual or user, such infrared light will be reflected to the receiver of the detector 4. A transmitter of the detector 4 emits the infrared light. When an object is disposed in the detector cone 5, the reflected infrared light can produce a signal in the circuit 8. The detector 4 is so constructed that it has a close range represented at 6 and a normal detected range as represented at 7. The close range has a maximum distance of about 100 mm from the detector 4. The normal range can extend from say about 100 mm to say 800 mm (preferably 600 mm to 800 mm) from the detector 4.

Usually the user will not position himself or herself in the path of water from the shower head 1 directly without being certain of the temperature. Furthermore, it is customary for the user to wish to interrupt at least full flow from the shower head during a soaping up operation. In addition, it may be undesirable to have the shower running while the shower fixtures or stall are being cleaned.

In consideration of all of these factors, it is advantageous to insure that the shower is operated while the user is in the normal detection region of the sensor but can be cut off when desired for soaping up without contacting an on or off switch or member for soaping up. It is also desirable to allow a contactless activation of the water flow. In the past this has not been possible and, especially in shower stalls, it has been necessary for the user to soap up while the shower is running at a normal flow rate. Indeed, even with open or row type showers it is desirable to cut off the flow but, if that is not possible, the user must step out of the range of the water emerging from the shower head.

This is achieved according to the invention by distinguishing between the close proximity region 6 and the normal region 7.

Figure 2:
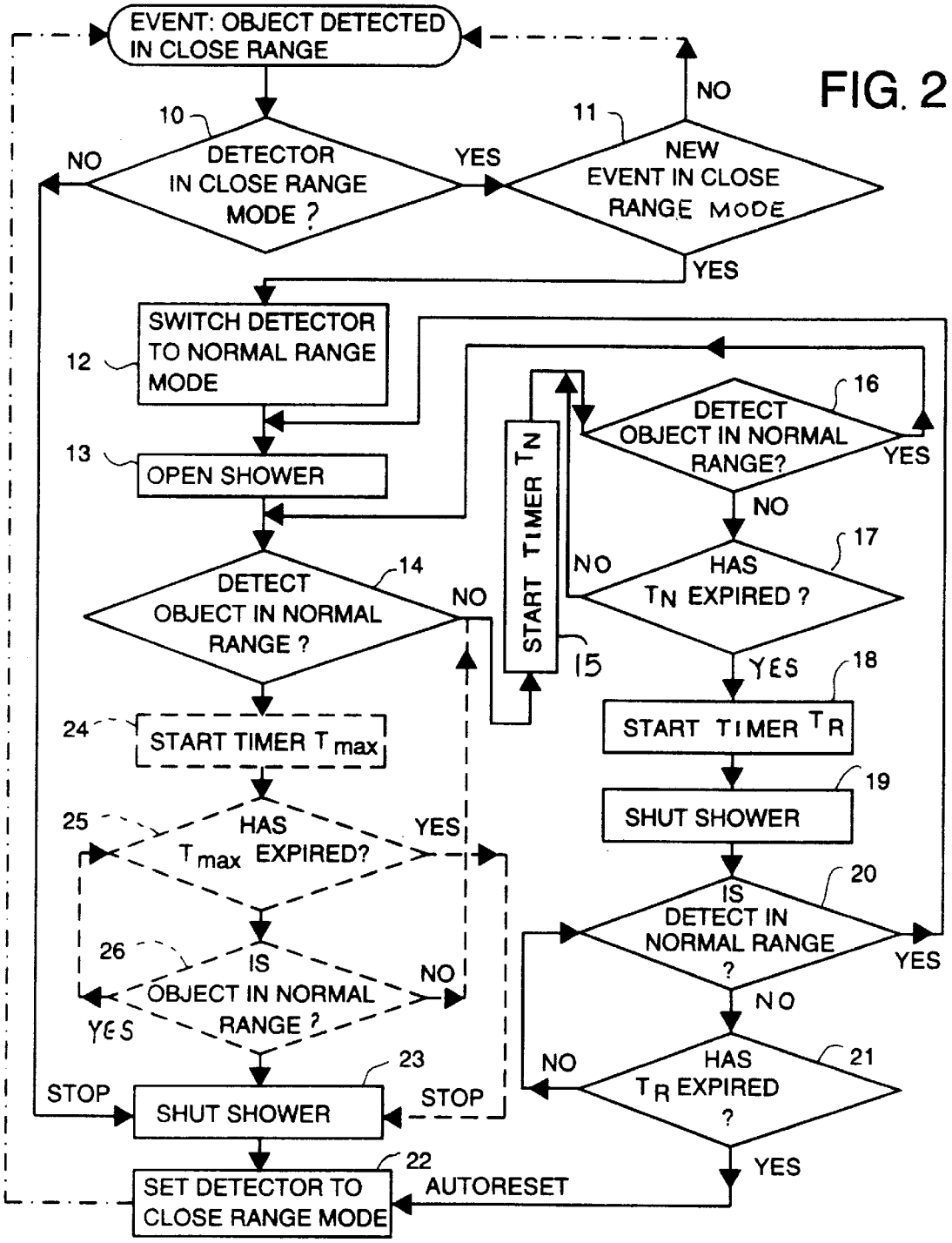
FIG. 2 is an algorithm diagram indicating the functioning of control and evaluation circuitry.

To activate the shower and commence the automatic shower control, a movement of the object into the close range 6, for example the hand of the user, is necessary. The simple presence of the user in the normal range 7 will not initiate a water flow. Water flow is thus commenced when the user himself or herself, for example, with his or her hand, approaches the proximity sensor within the range 6. With this movement, referred to as the event triggering the algorithm of FIG. 2, if the detector is in the close range as set at 22 and as tested at 10, the detector is switched to respond to the normal range 7 as represented at 12 and simultaneously the water flow to the shower is turned on at 13 and, if the presence of an object is detected in the normal range as tested at 14, showering continues until the stop function is triggered at 23'.

The sequence of operations does not initially depend upon the presence of an object in the normal detection range 7 but the detector is then switched to that normal range which is typically from 600 to 800 mm from the sensor 4 once the close range event occurs. The water flow allows the user to determine whether the water is at the proper temperature and to arrange for temperature adjustment by means not shown. Assuming the user finds the water to be at the proper temperature, he or she can then step into the normal range 7 below the shower and the shower is maintained in the on state. The test as to whether an object is within the normal range is effected at 14 and showering in a normal manner can continue.

To facilitate the operation of the shower at the first use by a user, around the detector 4 an illustration of the sequence can be provided on the shower stall wall to signal the user to bring his or her hand into proximity of the detector 4.

The water continues to flow for a maximum period $T_{MAX}$. To this end, once the test at 14 shows the presence of an object in the normal range, e.g. the user under the shower head 1, the timer for $T_{max}$ is set at 24 and as long as the test at 26 shows the object in the normal range and $T_{max}$ has not expired (test at 25), the shower remains ON. Upon the expiration of $T_{max}$ a stop signal is applied to shut down the shower at 23 and reset the detector to the close range mode at 22, awaiting a new event.

If at 14 (or 26) no object is detected within the normal range, a period $T_N$ is started by the setting of the $T_N$ timer 15 in the circuit. This allows the user to step out of the normal range to soap up or otherwise leave the region below head 1 for short periods during the shower.

If an object is detected within the normal range during this period (test 16), the shower continues to operate as indicated at 25, provided of course the period $T_{MAX}$ has not expired. This circumstance continues until $T_N$ expires as indicated at 17. Upon the expiration of the period $T_N$, a $T_R$ timer is set, setting a time interval during which the shower operation terminates if the shower is still running. The setting of the $T_R$ timer is represented at 18 in FIG. 2 and the turn off of the shower is represented at 19 and is automatically effected when the $T_R$ timer is set. Note that the stepping of the user into the normal range can restart the shower via detection at 20 until the period $T_R$ expires. Once the period $T_R$ has expired, as indicated at 21 in FIG. 2, the automatic reset to close range is effected at 22.

We claim:

1. A shower comprising:

a shower head;

a magnetic valve controlling flow of water to said shower head;

a proximity detector responsive to the presence of a user in a close range and in a normal range extending in a cone from said detector and which includes the path of water from said shower head, said proximity detector emitting a signal with intensity varying from a first intensity upon detecting an object in the close range to a second intensity once an object is detected in the normal range; and a control circuit connected between said valve and said proximity detector and responsive to the first and second intensity of the signal thus discriminating between an object in the close range and an object in the normal range, the control circuit:

initiating water flow upon movement of an object into said normal range in a mode corresponding to the presence of an object in said close range, setting a time interval $T_N$ during which water flow to said head is maintained if the presence of a user is or is not detected in said normal range, setting a time interval $T_R$ after termination of said time interval $T_N$ if the presence of a user is not detected in said normal range and for turning off said water flow upon termination of the interval $T_R$ during which said control circuit maintains the water flow, and resetting said mode corresponding to the presence of an object in said close range after termination of said time interval $T_R$.

2. The shower defined in claim 1 wherein said control circuit and said proximity detector are constructed and arranged so that said detector has a detector cone diverging from said detector, said close range extends from said detector to substantially 100 mm from said detector in said cone and said normal range extends from 100 mm from said detector to 800 mm from said detector along said cone.

3. The shower defined in claim 1 further comprising means in said control circuit for setting a maximum period of water flow from said shower head in said normal range.

* * * * *